United States Patent [19]

Libossart et al.

[11] 3,951,323

[45] Apr. 20, 1976

[54] REMOVABLE UPPER GUIDE ROLL UNIT IN A CONTINUOUS METAL CASTING INSTALLATION

[75] Inventors: Henri Libossart, Lezennes; Marcel Beghin, Lille, both of France

[73] Assignee: Fives-Cail Babcock, Paris, France

[22] Filed: Oct. 7, 1974

[21] Appl. No.: 512,683

[30] Foreign Application Priority Data

Oct. 2, 1973 France ..... 73.35120

[52] U.S. Cl. ..... 226/189; 164/282; 226/194

[51] Int. Cl.[2] ..... B65H 17/20; B65H 17/52

[58] Field of Search ..... 226/189, 194; 193/35 R, 193/35 C; 164/282; 198/127

[56] References Cited

UNITED STATES PATENTS

| | | | |
|---|---|---|---|
| 2,913,973 | 11/1959 | Bull et al. | 226/189 X |
| 3,837,390 | 9/1974 | Bode | 164/282 X |

*Primary Examiner*—Evon C. Blunk
*Assistant Examiner*—Bruce H. Stoner, Jr.
*Attorney, Agent, or Firm*—Kurt Kelman

[57] ABSTRACT

A unit of upper guide rolls is removably mounted in the interior of a support frame by means of a pair of upper trunnions and a pair of lower trunnions mounted on respective side walls of the unit. The entire weight of the unit is supported by the pair of upper trunnions. The trunnions are supported on the support frame and abutments for the trunnions prevent transverse movements of the unit.

7 Claims, 3 Drawing Figures

REMOVABLE UPPER GUIDE ROLL UNIT IN A CONTINUOUS METAL CASTING INSTALLATION

The present invention relates to improvements in the removable mounting of a unit of upper guide rolls in the interior of a fixed support frame in an installation for continuously casting molten metal. Such guide roll units comprise two parallel series of guide rolls for removing and guiding the cast ingot from the guiding mold.

Guide rolls of this type are of relatively small diameter and since they operate under very hard conditions, they must be frequently exchanged. Therefore, it has been proposed to provide removable units of guide rolls for the rapid exchange of the rolls. For instance, it has been proposed to mount the rolls on bed plates assembled with cheek plates to form a unit which is mounted in a framework fixed to the frame of the casting installation, the unit being removable from above.

The means for fixing the unit of guide rolls in the framework must assure precise positioning of the unit therein and must also make it possible to mount and detach the unit easily and rapidly.

It is the primary object of this invention to accomplish this purpose and the invention attains this object with a pair of upper trunnions and a pair of lower trunnions mounted on respective side walls of the unit, the entire weight of the unit being supported by a single pair of the trunnions. The single pair of trunnions are supported on the support frame and abutment means on the support frame for the upper and lower trunnions prevent transverse movements of the unit. The trunnions may be of cylindrical cross section having flattened side faces, or they may be of polygonal cross section.

The above and other objects, advantages and features of the present invention will become more apparent from the following detailed description of a now preferred embodiment thereof, taken in conjunction with the accompanying drawing wherein FIG. 1 is a side elevational view of an upper guide roll unit, the lower part of a side wall of the support frame being partly broken away to show the lower support for the unit;

Figure 1:
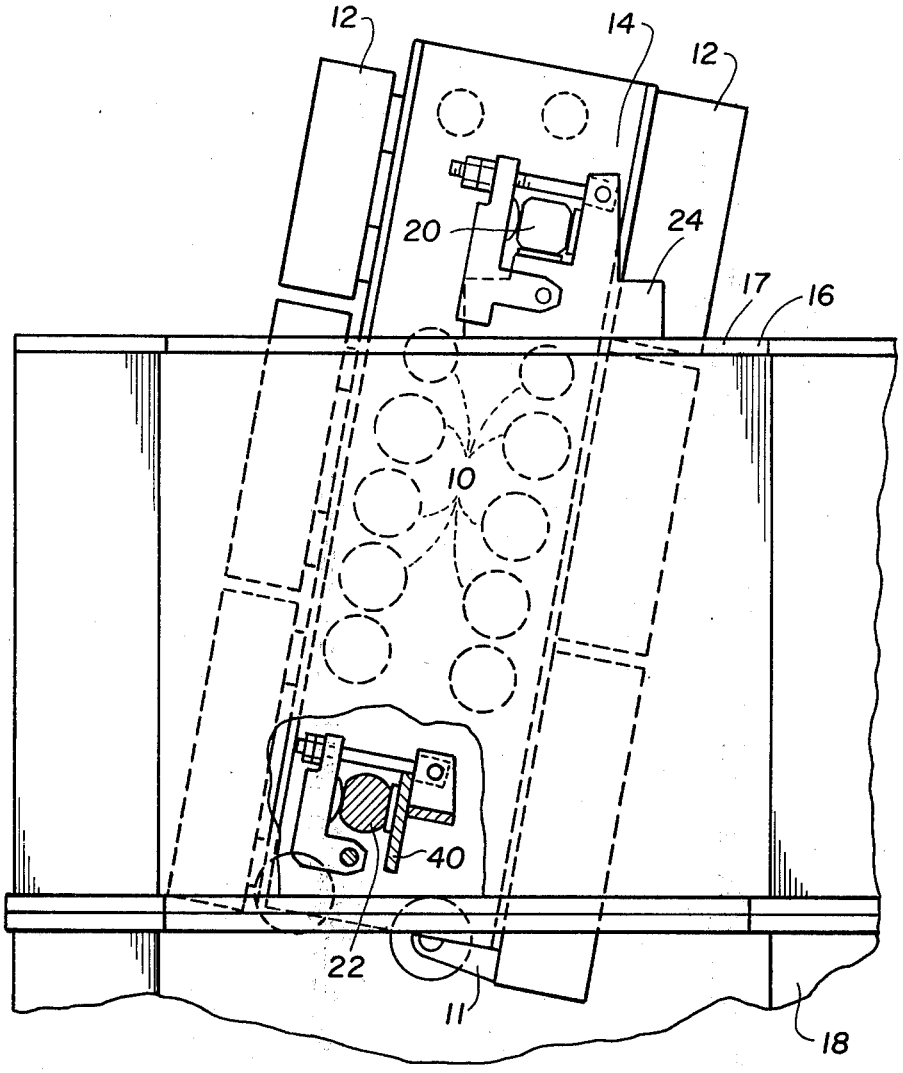

Referring now to the drawing and first to FIG. 1, the upper unit of guide rolls is designed to define a curved path for the ingot continuously cast from a mold (not shown) above the unit. This unit comprises two rows of guide rolls 10 defining therebetween the path for the cast metal, bearings 11 of the rolls being affixed to bed plates 12 braced by side walls 14 (the front side wall being removed to show the trunnion mountings of the invention in the interior of the unit). The bed plates and side walls are suitably assembled, for instance by tie rods, some rolls being omitted from the drawing to make the showing of the unit mounting clearer.

The upper unit of guide rolls is mounted in the interior of fixed support frame 16 which is mounted on frame 18 which carries additional guide rolls for the cast ingot, the casting mold (not shown) being supported on frame 16 or any other suitable support structure. Continuous ingot casting installations of this general type are well known.

The sole support for the unit of upper guide rolls 10 on support frame 16 is constituted by four trunnions

20, 22 mounted on respective ones of unit side walls 14 so that the unit is supported only at four points. In the illustrated embodiment, the upper trunnions 20 support the entire weight of the unit. They are supported on support bodies 24 fixedly mounted on upper ledge 17 of the support frame. Lower trunnions 22 are supported on support bodies 40 fixedly mounted on side walls 19 of the support frame.

Figure 2:
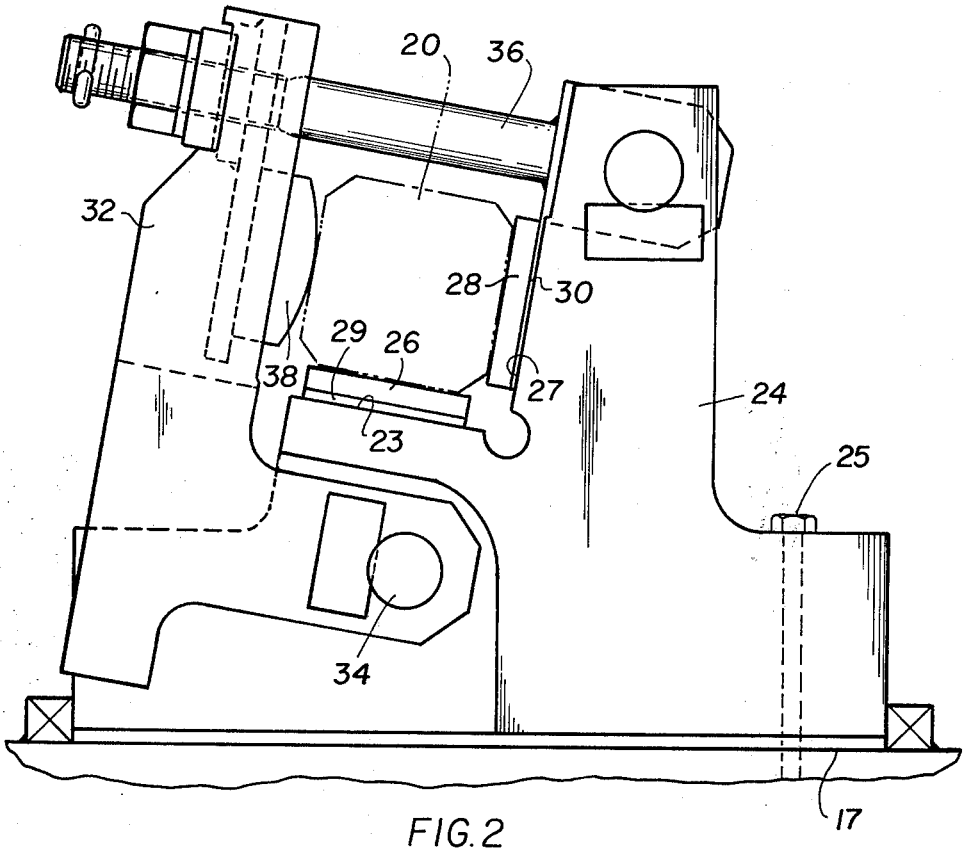
FIG. 2 is an enlarged side elevational view of the upper unit support.

The mounting for the upper trunnions is shown in FIG. 2. It comprises support body 24 affixed to upper support frame ledge 19 by bolts 25 and having machined thereon two mutually perpendicular surfaces, surface 23 being perpendicular and surface 27 being parallel to the axis of the cast ingot. Wedge plates 26 and 28 are screwed to othese surfaces, adjusting wedges 29 and 30 being interposed between the wedge plates and their supporting surfaces to enable the wedge plates to be suitably positioned for accurate positioning of the trunnion. Wedge plate 26 serves as supporting means for trunnion 20 while wedge plate 28 serves as a stationary abutment for the trunnion. The trunnion has flat sides in supporting contact with support plate 26 and abutment plate 28.

Movable abutment 38 in supporting contact with another flat side of trunnion 20 forms abutment means with stationary abutment 28 for the trunnion to prevent transverse movements of the unit. The movable abutment is mounted on support lever 32 pivotal about pivot axle 34 on support body 24, the axle being disposed below the trunnion so that the movable abutment is displaceably away from the stationary abutment for facilitating the assembly and disassembly of the unit in the support means. Means is provided for holding the pivotal lever tightly against the stationary abutment for holding the trunnion between stationary abutment 28 and movable abutment 38, the illustrated tightening means comprising two-part 36 linked to support body 24 and received in a bore in the free end of lever 32, the bolt having a handle for tightening it and thus to press the lever against the trunnion and to hold it firmly in position. The support surface of movable abutment 38 is curved or domed.

When it is desired to remove the unit from the support frame, trunnions 20 are readily disengageable by simply unscrewing bolt 36 and pivoting lever 32 back and away from support body 24. When the unit is put in place again, all that need be done is to pivot the lever towards support body 24 and to tighten the bolt. Lever 32 has an abutment to limit its pivoting movement.

Figure 3:
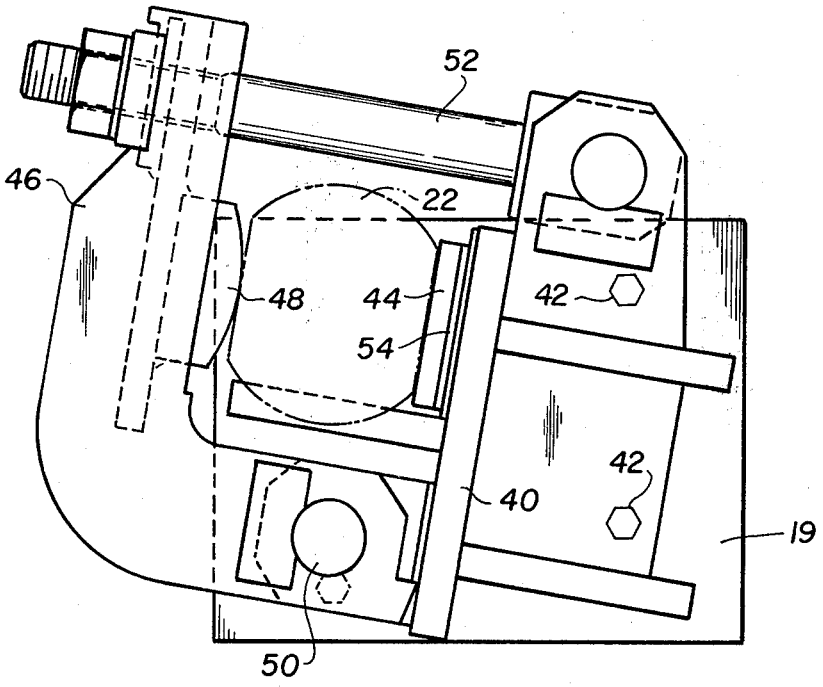
FIG. 3 is a like view of the lower unit supports.

FIG. 3 shows one of the lower supports for the unit of guide rolls. This support comprises support body 40 affixed by bolts 42 to side wall 19 of support frame 16 and having screwed thereto wedge plate 44 which forms a fixed abutment for trunnion 22 and is parallel to abutment plate 28 of trunnion 20. Trunnion 22 is of generally cylindrical cross section and has two parallel flat side faces extending parallel to the axis of the trunnion, one of the flat trunnion faces being in contact with abutment plate 44 while opposite abutment plate 48, which has a curved or domed abutment face, presses against the other flat trunnion face. Abutment 48 is carried by lever 46 which is pivotally mounted on support body 40 by pivot axle 50 extending parallel to, and below, the axis of trunnion 22. Bolt 52 is linked to support body 40 and enables the lever to be pressed against the support body by tightening of the bolt. Adjustment wedge plate 54 is disposed between support body 40 and abutment plate 44 to enable the trunnion to be accurately positioned.

The unit of guide rolls is moved into and out of support frame 16 from above after bolts 36 and 52 have been loosened and levers 32 and 46 have been pivoted away from trunnions 20 and 22. This makes it possible to move the trunnions into and out of their respective supports, the casting mold above the support frame first having been removed to enable the unit of guide rolls to be moved into and out of the support frame. The unit is placed into position by placing the upper trunnions 20 against abutment plates 28 and lower trunnions 22 against abutment plates 44. After that, bolts 36 and 52 are tightened to fix the trunnions in place. Tightening of the bolts may be effected by any suitable mechanical drive.

We claim:

1. In an installation for continuously casting molten metal, which comprises a fixed support frame and a unit of guide rolls, the unit having a pair of side walls and being removably mounted in the interior of the support frame, the improvement of a pair of upper trunnions and a pair of lower trunnions mounted on respective ones of the side walls, the entire weight of the unit being supported by a single pair of the trunnions, means for supporting the single pair of trunnions on the support frame, and abutment means on the support frame for the upper and lower trunnions, the abutment means preventing transverse movements of the unit and each abutment means comprising an abutment affixed stationarily to the support frame and an abutment movable in respect of the stationary abutment, the movable abutment being displaceable away from the stationary abutment for facilitating the assembly and disassembly of the unit in the installation.

2. In the casting installation of claim 1, the movable abutment being mounted on a support lever, a fixed axle for the support lever for enabling the lever to be pivoted away from the stationary abutment, and means for holding the pivotal lever tightly against the trunnion whereby the trunnion is held between the stationary and movable abutments.

3. In the casting installation of claim 2, wherein the movable abutment has a curved support surface facing the trunnion.

4. In the casting installation of claim 1, bearings between the trunnions and the supporting and abutment means.

5. In the casting installation of claim 1, the single pair of trunnions being the upper trunnions, the support frame comprising an upper ledge and the supporting means for the upper trunnions comprising supports mounted on the upper support frame ledge, the support frame comprising a pair of side walls and the supporting means for the lower trunnions comprising supports mounted on the side walls and extending into the interior of the support frame, and the abutment means being mounted on the supports.

6. In the casting installation of claim 5, the abutments means for each trunnion comprising a support lever, a fixed axle for the support lever below the trunnion for pivotally mounting the lever on respective one of the supports and a tightening bolt at the free end of the lever for tightening the lever about the trunnion.

7. In the casting installation of claim 6, the tightening bolt being joined to the support and being received in a bore in the free end of the lever for permitting the rapid opening and clearing of the lever about the trunnion.

* * * * *